US010996583B2

(12) United States Patent
Takezawa

(10) Patent No.: US 10,996,583 B2
(45) Date of Patent: May 4, 2021

(54) IMAGE FORMING APPARATUS

(71) Applicant: CANON KABUSHIKI KAISHA, Tokyo (JP)

(72) Inventor: Satoru Takezawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/784,042

(22) Filed: Feb. 6, 2020

(65) Prior Publication Data

US 2020/0278638 A1 Sep. 3, 2020

(30) Foreign Application Priority Data

Feb. 28, 2019 (JP) ..... JP2019-036674

(51) Int. Cl.

| | |
|---|---|
| ***G03G 15/04*** | (2006.01) |
| ***G03G 21/16*** | (2006.01) |
| ***G03G 15/043*** | (2006.01) |
| ***G03G 15/00*** | (2006.01) |

(52) U.S. Cl.

CPC ..... *G03G 15/04036* (2013.01); *G03G 15/043* (2013.01); *G03G 15/5054* (2013.01); *G03G 21/1666* (2013.01); *G03G 2215/00097* (2013.01); *G03G 2215/0897* (2013.01)

(58) Field of Classification Search

CPC ..... G03G 21/1666; G03G 15/04; G03G 15/04036; G03G 15/5041; G03G 15/5054; G03G 2215/0402; G03G 2221/1636

See application file for complete search history.

(56) References Cited

U.S. PATENT DOCUMENTS

| | | | | |
|---|---|---|---|---|
| 2009/0092407 | A1* | 4/2009 | Koie | H04N 1/0473 399/45 |
| 2014/0112676 | A1* | 4/2014 | Mori | G03G 15/55 399/49 |
| 2015/0192885 | A1* | 7/2015 | Hara | G03G 15/5037 399/48 |
| 2017/0075272 | A1* | 3/2017 | Kimura | G03G 21/20 |
| 2018/0017924 | A1* | 1/2018 | Matsumoto | G03G 15/556 |

FOREIGN PATENT DOCUMENTS

| | | |
|---|---|---|
| JP | 2009-008789 A | 1/2009 |
| JP | 2016-31467 A | 3/2016 |

* cited by examiner

*Primary Examiner* — Thomas S Giampaolo, II

(74) *Attorney, Agent, or Firm* — Canon U.S.A., Inc. I.P. Division

(57) ABSTRACT

An image forming apparatus including a photosensitive member, an optical scanning device including a transmission member configured to cause laser light for scanning the photosensitive member to pass through the transmission member, and a developing device configured to develop an electrostatic latent image with toner, the electrostatic latent image being scanned by the laser light and formed on the photosensitive member; a cleaning mechanism configured to clean the transmission member; a counter configured to store a count value that is a number of sheets on which an image forming operation is performed, and a control unit which executes a cleaning sequence before execution of an adjustment sequence, and resets the count value upon execution of the cleaning sequence, in a case where the count value is less than or equal to a predetermined value.

9 Claims, 12 Drawing Sheets

IMAGE FORMING APPARATUS

BACKGROUND

Field of the Disclosure

The present disclosure relates to an image forming apparatus, such as an electrophotographic copying machine and a laser beam printer, that forms an image on a recording medium by using an electrophotographic process.

Description of the Related Art

These days, an image forming apparatus that uses an electrophotographic process is provided with an optical scanning device that irradiates a surface of a charged photosensitive member with laser light to form an electrostatic latent image. The optical scanning device includes optical components (e.g., a light source and a mirror), a housing that covers the optical components, and an opening for emitting light from the light source to the outside of the housing. The opening is further closed by a transmission member, which allows the transmission of light, to prevent a foreign substance, such as toner and dust, from entering the housing.

If a foreign substance, such as toner and dust, is present on the transmission member, light emitted from the opening is blocked by the foreign substance, which may lead to a change in optical characteristics and deterioration in the quality of an image to be formed.

In this regard, Japanese Patent Application Laid-Open No. 2016-31467 discusses a structure for executing a cleaning sequence to cause a cleaning member to remove a foreign substance on a transmission member by moving the cleaning member while bringing the cleaning member into contact with the surface of the transmission member. Japanese Patent Application Laid-Open No. 2016-31467 further discusses a structure in which the cleaning sequence is executed, for example, every time when image forming operation has been carried out on 10,000 sheets.

On the other hand, in order to adjust image formation conditions for forming toner images on the photosensitive member, the image forming apparatus can execute an adjustment sequence for setting an amount of laser light from the optical scanning device so that an appropriate image density can be obtained. In this case, the image forming apparatus forms a toner pattern on the photosensitive member, and detects the density of the formed toner pattern. The adjustment sequence is executed when the environment in which the image forming apparatus is installed changes, or the image forming operation has been performed on a predetermined number of sheets.

In the case of executing the adjustment sequence, if a foreign substance (e.g., toner and paper dust) is present on the transmission member, laser light emitted from the optical scanning device is blocked by the foreign substance when a toner pattern is formed on the photosensitive member. Thus, an appropriate toner pattern cannot be formed, which makes it difficult to perform an appropriate image density adjustment.

It is possible to employ a structure in which the cleaning sequence is executed using the cleaning member, which is discussed in the Japanese Patent Application Laid-Open No. 2016-31467, before executing the adjustment sequence, to thereby remove the foreign substance on the transmission member.

However, in the structure in which the cleaning sequence is executed before the adjustment sequence is executed, the cleaning sequence is executed, when an instruction to execute the adjustment sequence is made. In a case where the number of sheets on which the image forming operation has performed is 9,999, the cumulative number of sheets reaches 10,000 when image forming operation is carried out on the next one sheet. Therefore, the cleaning sequence is executed again and may cause a user to wait through execution of more than one cleaning sequences.

SUMMARY

In view of the above description, the present disclosure is directed to providing an image forming apparatus that is capable of executing a cleaning sequence during execution of an image density adjustment sequence and preventing usability from being impaired even when the cleaning sequence can be executed for every predetermined number of sheets.

According to an aspect of the present disclosure, an image forming apparatus includes an image forming unit configured to form an image on a recording medium by transferring a toner image onto the recording medium, the image forming unit including a photosensitive member, an optical scanning device including a transmission member configured to cause laser light for scanning the photosensitive member to pass through the transmission member to an outside of the image forming apparatus, and a developing device configured to develop an electrostatic latent image with toner, the electrostatic latent image being scanned by the laser light and formed on the photosensitive member, a cleaning mechanism configured to clean the transmission member, a counter configured to store a count value that is a number of sheets on which an image forming operation is performed by the image forming unit, and a control unit configured to generate an execution signal to execute an adjustment sequence for causing the image forming unit to adjust an image formation condition for forming the toner image on the photosensitive member. The control unit executes a cleaning sequence for causing the cleaning mechanism to operate before execution of the adjustment sequence, and resets the count value held in the counter upon execution of the cleaning sequence, in a case where the execution signal is generated and the count value is less than or equal to a predetermined value.

Further features of the present disclosure will become apparent from the following description of exemplary embodiments with reference to the attached drawings.

DESCRIPTION OF THE EMBODIMENTS

An exemplary embodiment of the present disclosure will be described below with reference to the accompanying drawings. Unless otherwise specified, the scope of the disclosure is not limited only to the dimensions, materials, shapes, relative arrangements, and the like of components described in the following exemplary embodiments.

Figure 1:
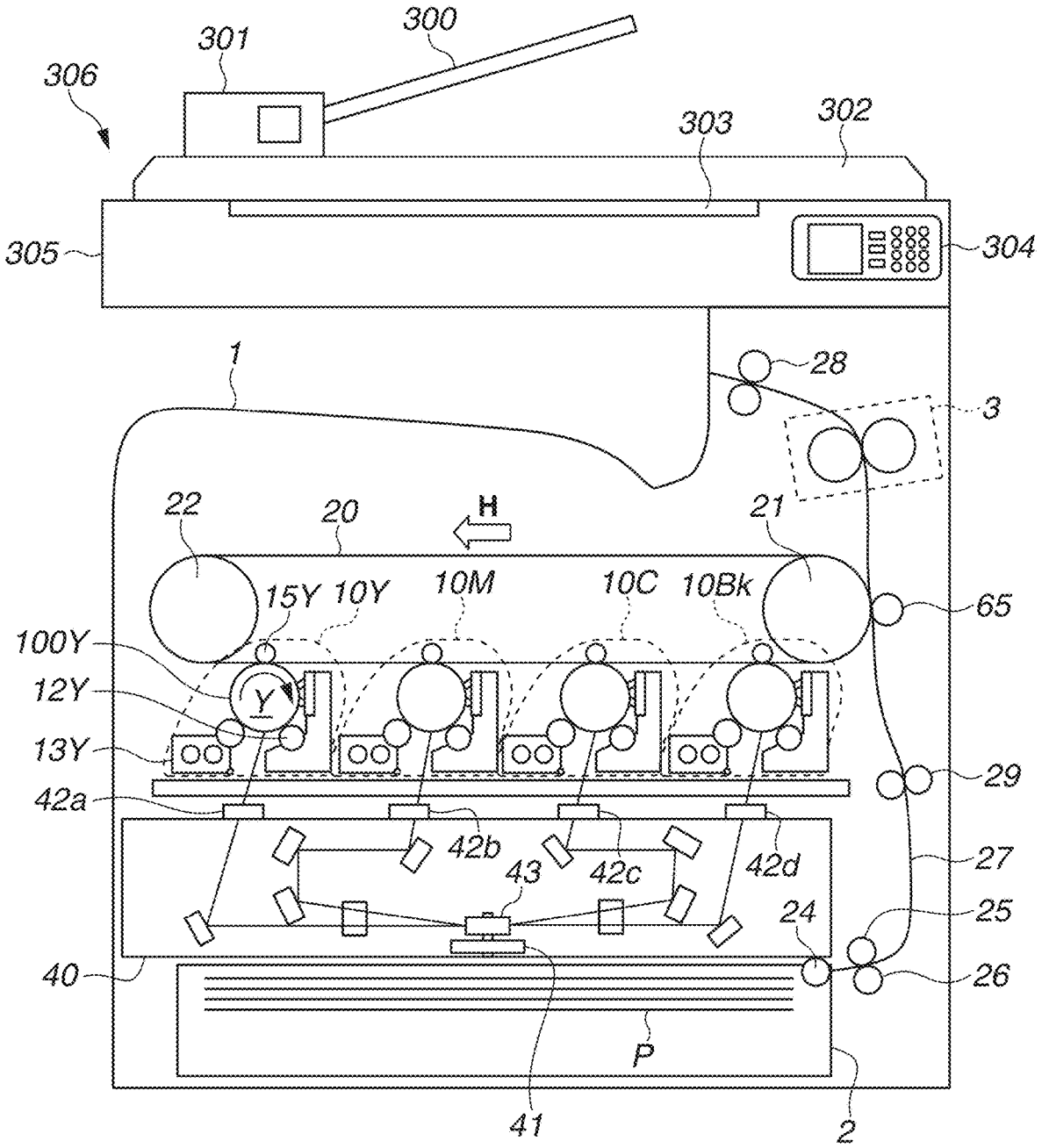
FIG. 1 is a schematic sectional view illustrating an image forming apparatus according to a first exemplary embodiment.

FIG. 1 is a schematic sectional view illustrating an image forming apparatus 1 according to a first exemplary embodiment. As illustrated in FIG. 1, the image forming apparatus 1 according to the present exemplary embodiment is a tandem type color laser beam printer including four image forming portions 10Y, 10M, 10C, and 10Bk, which form toner images of yellow (Y), magenta (M), cyan (C), and black (Bk), respectively.

The image forming apparatus 1 according to the present exemplary embodiment includes a reader portion 306 that is provided at an upper portion of a main body of the image forming apparatus 1. The reader portion 306 includes a document conveying device 301 that automatically conveys a document, a document reading device 305 that reads an image on the conveyed document, and a document discharge tray 302 onto which the document is discharged.

The document conveying device 301 includes a document feed tray 300 on which documents are set. The document conveying device 301 conveys the documents, which are placed on the document feed tray 300, one by one to a document reading position on a glass 303. Each document conveyed onto the glass 303 is scanned by a scanner (not illustrated), such as a charge-coupled device (CCD) and a contact image sensor (CIS), which is provided in the document reading device 305. The document conveying device 301 further conveys the document, and discharges the document onto the document discharge tray 302.

The document conveying device 301 is openable/closable with respect to the document reading device 305. An operator can place a document on the glass 303 by opening the document conveying device 301.

The scanner irradiates the document conveyed by the document conveying device 301 onto the glass 303 or a document placed on the glass 303 with light from a light source. The scanner receives reflected light from the document by a light receiving sensor, and converts the light into an electrical signal. The converted electrical signal including red (r), green (g), and blue (b) components is output to a control unit, such as a central processing unit (CPU), described below.

As illustrated in FIG. 1, the image forming apparatus 1 according to the present exemplary embodiment includes an operation portion 304. The operation portion 304 includes a display that displays, for example, setting information about printing conditions, for the operator such as a user and a service person.

The display can display software keys on which a touch operation is performed by the operator touching with his/her finger. This enables the operator to input information to instruct, for example, single-sided printing or double-sided printing, via an operation panel.

The operation portion 304 includes a start key to be pressed to start an image forming operation, and a stop key to be pressed to interrupt the image forming operation. A numeric keypad configured on the operation portion 304 is used to set, for example, the number of sheets on which the image forming operation is performed. In the image forming apparatus 1 according to the present exemplary embodiment, the operation portion 304 includes the start key, the stop key, and the keypad as hardware keys. However, these keys may be displayed as software keys on the display. Various data input by the operation portion 304 is stored in a random access memory (RAM) through a CPU.

The image forming apparatus 1 includes an intermediate transfer belt 20 onto which the toner images formed by the image forming portions 10Y, 10M, 10C, and 10Bk are transferred. The intermediate transfer belt 20 is an example of a transfer unit.

The toner images, which are transferred in a superimposed manner onto the intermediate transfer belt 20 from the image forming portions 10Y, 10M, 10C, and 10Bk, are transferred onto a sheet P, which is a recording medium, to form a color image. The image forming portions 10Y, 10M, 10C, and 10Bk have substantially the same structure, except that their toner colors are different. In the following description, the image forming portion 10Y is described as an example of the image forming portions 10, and repeated descriptions of the image forming portions 10M, 10C, and 10Bk are omitted. Not only paper used for general printing, but also fabrics, plastic, films, and the like can be widely used as the recording medium according to the present exemplary embodiment.

Each image forming portion 10 includes a photosensitive member 100, a charging roller 12, a developing device 13, and a primary transfer roller 15. The charging roller 12 charges the photosensitive member 100 with a uniform background potential. The developing device 13 develops an electrostatic latent image formed on the photosensitive member 100 by an optical scanning device 40 (described below) to form a toner image. The primary transfer roller 15 transfers the formed toner image onto the intermediate transfer belt 20. A primary transfer portion is formed between the primary transfer roller 15 and the photosensitive member 100 via the intermediate transfer belt 20. A predetermined transfer voltage is applied to the primary transfer roller 15 to transfer the toner image formed on the photosensitive member 100 onto the intermediate transfer belt 20.

The intermediate transfer belt 20 is formed in an endless shape, and looped across a first belt conveyance roller 21 and a second belt conveyance roller 22. The toner image formed by each image forming portion 10 is transferred onto the intermediate transfer belt 20 while the intermediate transfer belt 20 is rotated in a direction of an arrow H. The four image forming portions 10Y, 10M, 10C, and 10Bk are arranged in parallel at a lower side in a vertical direction of the intermediate transfer belt 20. The toner images formed based on image information for the respective colors are transferred onto the intermediate transfer belt 20. An image formation process for each color is performed by each image forming portion 10 to match the timing when each toner image is superimposed on the toner image that has been primarily transferred onto the upstream intermediate transfer belt 20. Accordingly, four-color toner images are formed in a superimposed manner on the intermediate transfer belt 20.

The first belt conveyance roller 21 is in press contact with a second transfer roller 65 through the intermediate transfer belt 20. A second transfer portion that transfers the toner images onto the sheet P is formed between the first belt conveyance roller 21 and the second transfer roller 65 through the intermediate transfer belt 20. The sheet P is inserted into the second transfer portion, so that the toner images are transferred onto the sheet P from the intermediate transfer belt 20. Transfer residual toner remaining on the surface of the intermediate transfer belt 20 is collected by a cleaning device (not illustrated).

As the image forming portions 10 for the respective colors, the image forming portion 10Y that forms a yellow toner image, the image forming portion 10M that forms a magenta toner image, the image forming portion 10C that forms a cyan toner image, and the image forming portion 10Bk that forms a black toner image are arranged in this order from the upstream side with respect to the secondary transfer portion in a rotation direction (direction of arrow H) of the intermediate transfer belt 20.

The optical scanning device 40 is provided vertically below the image forming portions 10 as an optical scanning unit. The optical scanning device 40 scans each photosensitive member 100 with laser light and forms an electrostatic latent image corresponding to information about an image to be formed on the corresponding photosensitive member 100. The image forming portion 10 and the optical scanning device 40 are examples of an image forming unit.

The optical scanning device 40 includes four semiconductor laser units (not illustrated) that emit laser light modulated according to image information for the respective colors. The optical scanning device 40 also includes a motor unit 41 and a rotary polygonal mirror 43. The rotary polygonal mirror 43 is rotated at a high speed by the motor unit 41 to deflect laser light emitted from each of the semiconductor laser units so that scanning is performed with the laser light along a rotational axis direction of the corresponding photosensitive member 100. The laser light deflected by the rotary polygonal mirror 43 is guided by an optical member disposed on the inside of the optical scanning device 40. The laser light is emitted outward from the inside of the optical scanning device 40 through transmission members 42*a* to 42*d* that cover respective openings formed at an upper portion of the optical scanning device 40. Accordingly, the corresponding photosensitive member 100 is exposed to the laser light emitted outward of the optical scanning device 40.

The sheets P are stored in a sheet feed cassette 2 that is disposed at a lower portion of the image forming apparatus 1. Each sheet P is fed by a pickup roller 24 to a separation nip portion that is formed by a feed roller 25 and a retard roller 26. In this case, a driving force is transmitted to the retard roller 26 so that the retard roller 26 is reversely rotated when a plurality of sheets P is fed by the pickup roller 24. And thus the sheets P are conveyed one by one to the downstream side, to thereby prevent double feeding of the sheets P. The sheets P conveyed one by one by the feed roller 25 and the retard roller 26 are further conveyed to a conveyance path 27 that extends substantially vertically along a right side surface of the image forming apparatus 1.

Each of the sheets P is conveyed from the lower side to the upper side in the vertical direction of the image forming apparatus 1 through the conveyance path 27, and is conveyed to registration rollers 29. The registration rollers 29 temporarily stop the sheet P to be conveyed and correct a skew of the sheet P. The registration rollers 29 then convey the sheet P to the second transfer portion to match the timing when the toner images formed on the intermediate transfer belt 20 are conveyed to the secondary transfer portion. Thereafter, the sheet P onto which the toner images are transferred at the secondary transfer portion is conveyed to a fixing unit 3 and is heated and pressed by the fixing unit 3, so that the toner images are fixed onto the sheet P. The sheet P onto which the toner images are fixed is then discharged onto a discharge tray by discharge rollers 28. The discharge tray is provided at an upper portion of the main body of the image forming apparatus 1 and is located on the outside of the image forming apparatus 1.

In the structure in which the image forming portions 10 are provided above the optical scanning device 40 in the main body of the image forming apparatus 1 as described above, a foreign substance, such as toner, paper dust, and dust, may fall onto the transmission members 42*a* to 42*d*, which are provided at the upper portion of the optical scanning device 40, during the image forming operation. In this case, the laser light emitted to each photosensitive member 100 through the transmission members 42*a* to 42*d* is blocked by the foreign substance. Accordingly, optical characteristics may be changed due to the foreign substance, which may lead to deterioration in the quality of an image to be formed.

Figure 2:
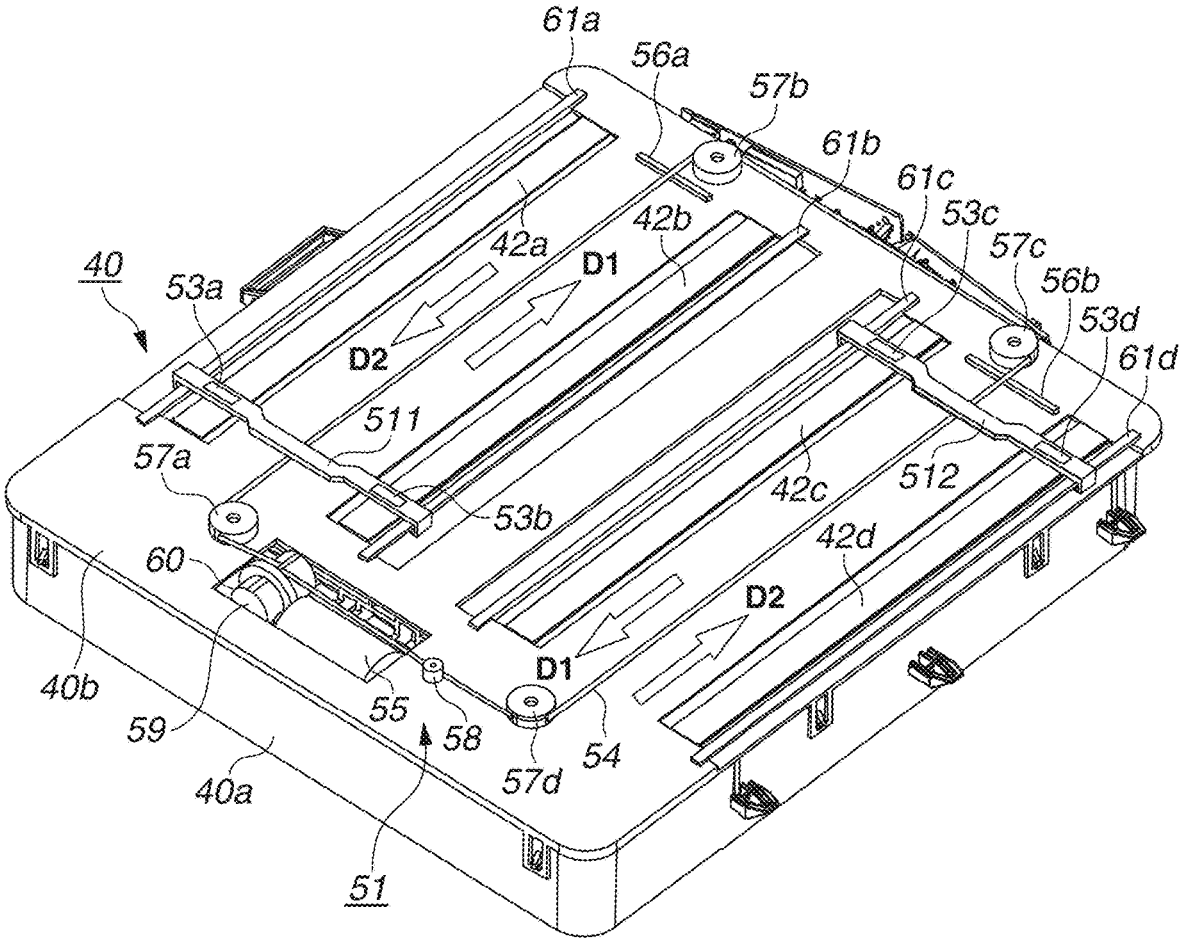
FIG. 2 is a perspective view of an optical scanning device.
Figure 3:
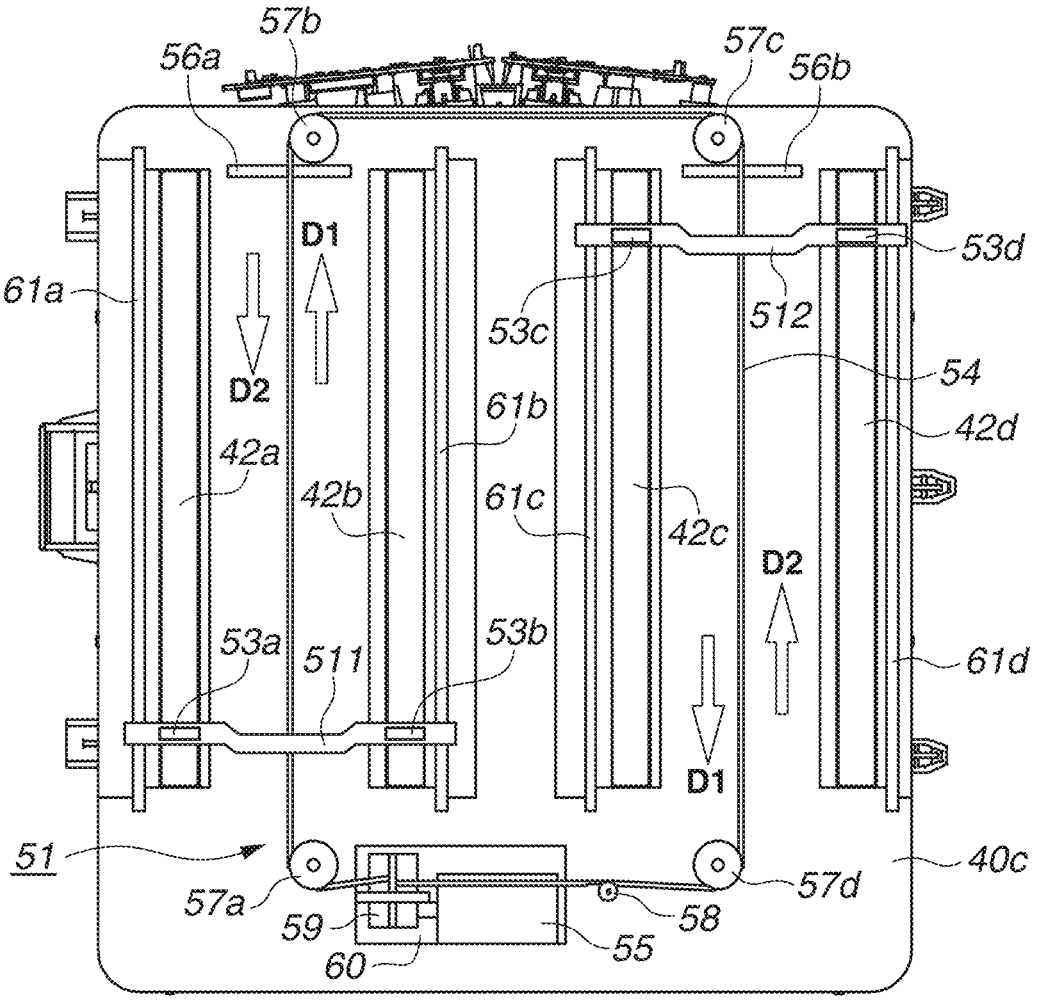
FIG. 3 is a top view of the optical scanning device.

Therefore, according to the present exemplary embodiment, the optical scanning device 40 is provided with a cleaning mechanism 51 that cleans the transmission members 42*a* to 42*d*. The optical scanning device 40 and the cleaning mechanism 51, which is provided on the optical scanning device 40, will be described in detail below. FIG. 2 is a perspective view illustrating the entire structure of the optical scanning device 40. FIG. 3 illustrates a top view of the optical scanning device 40.

As illustrated in FIGS. 2 and 3, the optical scanning device 40 includes a storage portion 40*a*, and a cover portion 40*b*. The storage portion 40*a* stores the motor unit 41 and the rotary polygonal mirror 43 described above. The cover portion 40*b* is attached to the storage portion 40*a* and covers a top surface of the storage portion 40*a*. The storage portion 40*a* and the cover portion 40*b* constitute a housing for the optical scanning device 40. The cover portion 40*b* is provided with four openings through which respective laser beams from the photosensitive members 100 for the respective colors pass. The openings each have a rectangular shape that is long in the rotational axis direction of the corresponding photosensitive member 100, and are formed to extend in parallel in a longitudinal direction. Further, the openings are closed by the transmission members 42*a* to 42*d*, respectively, which are formed in a long rectangular shape. Like the openings, the transmission members 42*a* to 42*d* are provided and attached to the cover portion 40*b* such that the transmission members 42*a* to 42*d* extend in parallel in the longitudinal direction. The longitudinal direction of each of the transmission members 42*a* to 42*d* is substantially identical to a scanning direction of the laser light emitted from the optical scanning device 40. In the present exemplary embodiment, the longitudinal direction of each of the transmission members 42*a* to 42*d* is substantially identical to the rotational axis direction of each photosensitive member 100.

The transmission members 42*a* to 42*d* are provided to prevent a foreign substance, such as toner, dust, and paper dust, from entering the optical scanning device 40. Thus, the transmission members 42*a* to 42*d* prevent degradation in image quality due to adherence of the foreign substance to the semiconductor laser units, mirrors, the rotary polygonal mirror 43, and the like. The transmission members 42*a* to 42*d* are formed of a transparent member, such as glass, and can emit laser light output from the semiconductor laser units in the storage portion 40*a* to the corresponding photosensitive member 100. In the present exemplary embodiment, the size of each of the transmission members 42*a* to 42*d* is set to be larger than the size of each opening so that the transmission members 42*a* to 42*d* cover the openings, respectively, in an overlapping manner. Further, overlapping portions where the transmission members 42*a* to 42*d* overlap the openings are attached to the openings, and thereby fix the transmission members 42*a* to 42*d* to the cover portion 40*b*.

As described above, the optical scanning device 40 is covered with the cover portion 40*b* and the transmission members 42*a* to 42*d*, thereby preventing a foreign substance, such as toner, paper dust, and dust, from entering the optical scanning device 40. Further, the transmission members 42*a* to 42*d* each having a size larger than the size of each opening are attached and fixed onto the cover portion 40*b*, thereby preventing a foreign substance, such as toner, paper dust, and dust, from falling down from the upper portion of the optical scanning device 40 and entering the optical scanning device 40 through gaps formed between the transmission members 42*a* to 42*d* and each of the openings.

In the present exemplary embodiment, the optical scanning device 40 includes the cleaning mechanism 51 that performs a cleaning process for cleaning the foreign substance falling onto the top surface (e.g., top surface of each of the transmission members 42*a* to 42*d*) of the optical scanning device 40 from above. The top surface of each of the transmission members 42*a* to 42*d* is a surface that is located outside the optical scanning device 40 and positioned at a side where the laser light is emitted outward passing through the transmission members 42*a* to 42*d*.

The cleaning mechanism 51 is attached to a side that is located on the cover portion 40*b* of the optical scanning device 40, and is opposed to each image forming portion 10. The cleaning mechanism 51 includes cleaning members 53*a* to 53*d*, and a first cleaning holder 511 and a second cleaning holder 512. The cleaning members 53*a* to 53*d* clean the top surfaces (surfaces on the outside of the optical device 40) of the transmission members 42*a* to 42*d*, respectively. The first and second cleaning holders 511 and 512 hold the cleaning members 53*a* to 53*d*, and move the cleaning members on the transmission members 42*a* to 42*d*.

The first cleaning holder 511 and the second cleaning holder 512 each extend along a direction orthogonal to the direction in which the transmission members 42*a* to 42*d* extend, and straddle two adjacent transmission members 42. The first and second cleaning holders 511 and 512 each include two cleaning members 53. The number of the cleaning members 53 included in each of the first cleaning holder 511 and the second cleaning holder 512 corresponds to the number of the transmission members 42.

Specifically, the first cleaning holder 511 includes the cleaning member 53*a* that is disposed to straddle the transmission members 42*a* and 42*b* and cleans the top surface of the transmission member 42*a*, and the cleaning member 53*b* that cleans the top surface of the transmission member 42*b*. The second cleaning holder 512 includes the cleaning member 53*c* that is disposed to straddle the transmission members 42*c* and 42*d* and cleans the top surface of the transmission member 42*c*, and the cleaning member 53*d* that cleans the top surface of the transmission member 42*d*.

The cleaning members 53*a* to 53*d* are each formed of, for example, silicon rubber or non-woven fabric. The cleaning members 53*a* to 53*d* move in contact with the top surface of the transmission member 42 along with the movement of each of the first cleaning holder 511 and the second cleaning holder 512, thereby making it possible to remove the foreign substance on the transmission member 42 and to clean the surface of the transmission member 42.

A center portion of the first cleaning holder 511 is coupled to a wire 54. The first cleaning holder 511 holds the cleaning members 53*a* and 53*b* at both ends thereof with the wire 54 at a center. A center portion of the second cleaning holder 512 is coupled to the wire 54. The second cleaning holder 512 holds the cleaning members 53*c* and 53*d* at both ends thereof with the wire 54 at the center. Thus, the wire 54 is held under tension such that the wire 54 goes through between the transmission members 42*a* and 42*b* and between the transmission members 42*c* and 42*d*.

Further, the wire 54 is held under tension in a ring shape above the cover portion 40*b* by four tension pulleys 57*a* to 57*d*, a tension adjustment pulley 58, and a winding drum 59, which are rotatably held by the cover portion 40*b*. The wire 54 is stretched over the tension pulleys 57*a* to 57*d* in a state where the length of the wire 54 is adjusted by winding the wire 54 around the winding drum 59 by a predetermined number of times during assembly of the image forming apparatus 1. In this case, the four tension pulleys 57*a* to 57*d* are arranged such that the wire 54 passes between the transmission members 42*a* and 42*b* and between the transmission members 42*c* and 42*d* as described above.

A tensile force of the wire 54 is adjusted by the tension adjustment pulley 58 which is provided between the tension pulleys 57*a* and 57*d*. Accordingly, the wire 54 is disposed in a state where the wire 54 is held under tension between the tension pulleys 57*a* to 57*d*, the tension adjustment pulley 58, and the winding drum 59. Thus, the wire 54 can be smoothly arranged in an annular shape by holding the wire 54 under tension.

In the present exemplary embodiment, the tension adjustment pulley 58 is provided between the tension pulleys 57*a* and 57*d*. However, the position of the tension adjustment pulley 58 is not limited to this position, as long as the tensile force of the wire 54, which is stretched over the tension pulleys 57*a* to 57*d*, can be adjusted at the position.

As described above, in the present exemplary embodiment, the first cleaning holder 511 is provided with the cleaning members 53*a* and 53*b*, and the second cleaning holder 512 is provided with the cleaning members 53*c* and 53*d*. On the other hand, in a case where a single cleaning member is held by a single cleaning holder, there is a need to provide a number of cleaning holders corresponding to the number of transmission members, which leads to an increase in the length of the wire 54 for holding the cleaning holders under tension. Accordingly, in the present exemplary embodiment, the number of cleaning holders can be reduced and the length of the wire 54 can be reduced as compared with a structure in which a single cleaning member is held by a single cleaning holder. Consequently, the top surface of each of the transmission members 42*a* to 42*d* can be cleaned with a simpler structure.

The winding drum 59 can be rotated by being driven by a winding motor 55 which is a driving unit.

The winding motor 55 rotates forwardly and reversely. In the present exemplary embodiment, the direction in which the winding motor 55 is forwardly rotated is referred to as a clockwise (CW) direction. The direction in which the winding motor 55 is reversely rotated is referred to as a counterclockwise (CCW) direction.

The wire 54 is wound around or drawn out from the winding drum 59, accordingly, when the winding drum 59 rotates along with the rotation of the winding motor 55 in the CW direction or the CCW direction. Thus, the wire 54 can move in an annular shape above the cover portion 40*b* in a state where the wire 54 is stretched over the tension pulleys 57*a* to 57*d*, when the wire 54 is wound around or drawn out from the winding drum 59.

The first cleaning holder 511 and the second cleaning holder 512, which are coupled to the wire 54, are movable along the arrangement of the wire 54 in directions of arrows D1 and D2 (e.g., longitudinal direction of the transmission member 42), accordingly. In the present exemplary embodiment, the first cleaning holder 511 and the second cleaning holder 512 move in the direction of the arrow D1 along with the rotation of the winding motor 55 in the CCW direction. Further, the first cleaning holder 511 and the second cleaning holder 512 move in the direction of the arrow D2 along with the rotation of the winding motor 55 in the CW direction.

Since the wire 54 is held under tension in an annular shape, the first cleaning holder 511 and the second cleaning holder 512 are configured to move linearly in opposite directions in the longitudinal direction of the transmission members 42*a* to 42*d* along with the movement of the wire 54.

The winding motor 55 and the winding drum 59 are provided in a recess 60 that is recessed with respect to the top surface of the cover portion 40*b*. With this structure, the size in the height direction of the optical scanning device 40 can be reduced. The recess 60 does not communicate with the inside of the optical scanning device 40, and is provided such that a foreign substance is prevented from entering the optical scanning device 40 from the recess 60.

The cover portion 40*b* is also provided with a first stopper 56*a* that regulates a movement of the first cleaning holder 511 in the longitudinal direction (e.g., rotational axis direction of the photosensitive member 100) of the transmission members 42*a* and 42*b*. The cover portion 40*b* is also provided with a second stopper 56*b* that regulates a movement of the second cleaning holder 512 in the longitudinal direction (e.g., rotational axis direction of the photosensitive member 100) of the transmission members 42*c* and 42*d*. The first stopper 56*a* and the second stopper 56*b* are examples of an abutting member.

The first stopper 56*a* and the second stopper 56*b* are provided at one end in the longitudinal direction of the transmission members 42*a* to 42*d*. Thus, the first cleaning holder 511 reaches an end portion of each of the transmission members 42*a* and 42*b* in the direction of the arrow D1 and abuts against the first stopper 56*a*, when the first cleaning holder 511 and the second cleaning holder 512 move in the direction of the arrow D1.

Since the movement of the first cleaning holder 511 in the direction of the arrow D1 is regulated by the first stopper 56*a*, a large load acts on the winding motor 55 that causes the winding drum 59 to be rotated to feed the wire 54. A current detection portion described below is used to detect the load, so that it can be detected that the first cleaning holder 511 has reached the first stopper 56*a*. At this time, the second cleaning holder 512 is located on an opposite side of the first cleaning holder 511 in the longitudinal direction of the transmission member 42.

A series of cleaning processes performed along with the movement of the first cleaning holder 511 and the second cleaning holder 512 according to the present exemplary embodiment will be described below.

The wire 54 is fed in the direction of the arrow D2, and the first cleaning holder 511 and the second cleaning holder 512 move in the direction of the arrow D2, when the winding motor 55 is rotationally driven in the CW direction.

After that, the second cleaning holder 512 reaches an end portion of each of the transmission members 42*c* and 42*d* in the direction of the arrow D2, and then abuts against the second stopper 56*b*. Since the movement of the second cleaning holder 512 in the direction of the arrow D2 is regulated by the second stopper 56*b*, a large load acts on the winding motor 55 that causes the winding drum 59 to be rotated to feed the wire 54, accordingly. The current detection portion described below is used to detect the load, so that it can be detected that the second cleaning holder 512 has reached the second stopper 56*b*.

When it is detected that the second cleaning holder 512 has reached the second stopper 56*b*, the rotation of the winding motor 55 is stopped. At this time, the first cleaning holder 511 is located at the other end in the longitudinal direction of the transmission member 42 and reaches a second position. Accordingly, the movement of the transmission member 42 in the longitudinal direction is stopped at the second position by the stop of the rotation of the winding motor 55.

The winding motor 55 is then rotated in the CCW direction, thereby feeding the wire 54 in the direction of the arrow D1. Thus, the first cleaning holder 511 and the second cleaning holder 512 move in the direction of the arrow D1.

The first cleaning holder 511 then reaches an end portion of each of the transmission members 42*a* and 42*b* in the direction of the arrow D1 and abuts against the first stopper 56*a*. Since the movement of the first cleaning holder 511 in the direction of the arrow D1 is regulated by the first stopper 56*a*, a large load acts on the winding motor 55 that causes the winding drum 59 to be rotated to feed the wire 54, accordingly. The current detection portion described below is used to detect the load, so that it can be detected that the first cleaning holder 511 has reached the first stopper 56*a*.

When it is detected that the first cleaning holder 511 has reached the first stopper 56*a*, the rotation of the winding motor 55 in the CCW direction is stopped, and then the winding motor 55 is rotated in the CW direction by a predetermined number of rotations. Thus, the wire 54 is fed in the direction of the arrow D2 only by a predetermined distance, and then the rotation of the winding motor 55 is stopped.

As described above, in the present exemplary embodiment, a process in which the first cleaning holder 511 and the second cleaning holder 512 move forward and backward once above the transmission members 42*a* to 42*d* once is referred to as a series of cleaning processes. After completion of the series of cleaning processes, the operation is stopped at a position by feeding the wire 54 in the direction of the arrow D2 only by a predetermined distance. The position is a position where the cleaning holder 511 is prevented from abutting against the first stopper 56*a*, and the cleaning member 53 is not in contact with the surface of the transmission member 42.

Specifically, the first cleaning holder 511 is positioned between the first stopper 56*a* and an end portion of the transmission member 42 in the longitudinal direction of the transmission member 42, and is positioned in a non-passage area where no laser light passes in the transmission member 42. At this time, the second cleaning holder 512 stops the operation at a position that is not in contact with an end portion of the transmission member 42 in the longitudinal direction, i.e., in the non-passage area where no laser light passes in the transmission member 42.

In the series of cleaning processes described above, the rotation of the winding motor 55 is stopped and then the winding motor 55 is rotated in the CCW direction, when it is detected that the second cleaning holder 512 has reached the first stopper 56*a*. However, the winding motor 55 may be rotated in the CCW direction when it is detected that the second cleaning holder 512 has reached the second stopper 56*b*.

In the present exemplary embodiment, the winding motor 55 is forwardly rotated (e.g., in the CW direction) to thereby feed the wire 54 in the direction of the arrow D1, and the winding motor 55 is reversely rotated (e.g., in the CCW direction) to thereby feed the wire 54 in the direction of the arrow D2. However, the winding motor 55 may be forwardly rotated to thereby feed the wire 54 in the direction of the arrow D2, and the winding motor 55 may be reversely rotated to thereby feed the wire 54 in the direction of the arrow D1.

Figure 4:
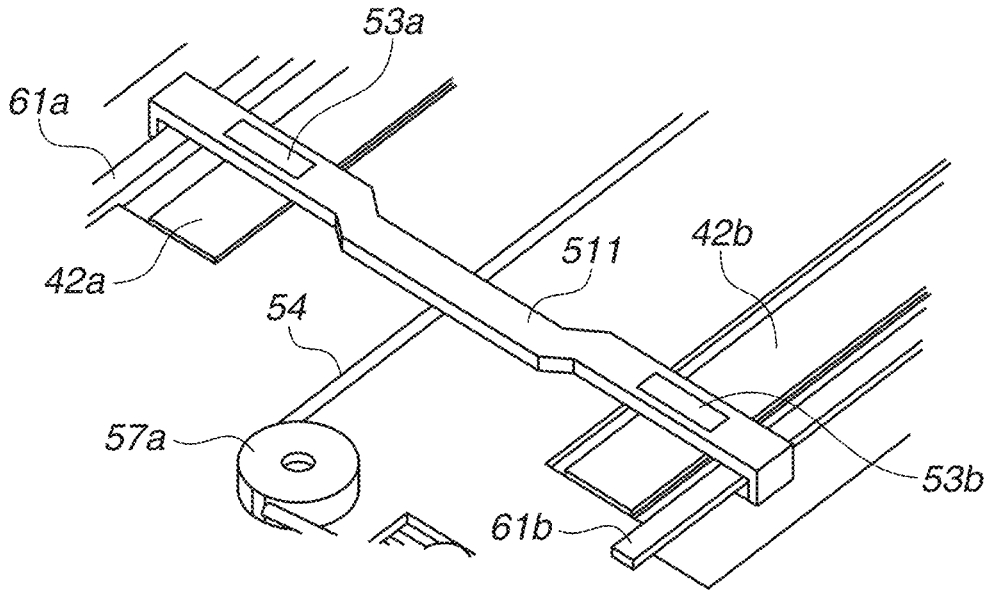
FIG. 4 is a partial perspective view of a first cleaning holder.
Figure 5:
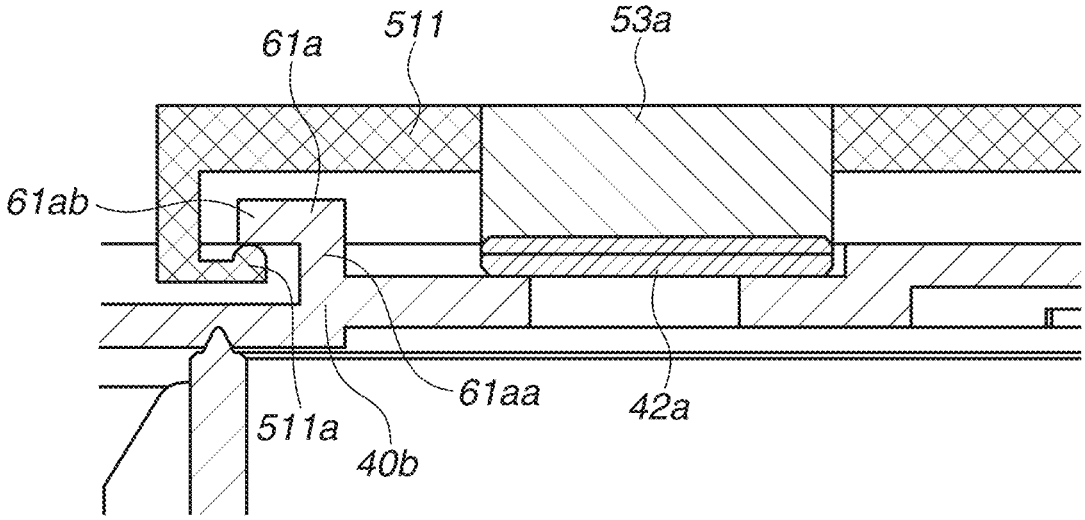
FIG. 5 is a partial sectional view of the first cleaning holder.

The cover portion 40*b* is provided with guide members 61*a* to 61*d* that guide the movement of each of the first cleaning holder 511 and the second cleaning holder 512. As illustrated in FIGS. 4 and 5, both end portions of the first cleaning holder 511 engage with the guide members 61*a* and 62*b*, respectively.

FIG. 4 is a partial perspective view illustrating an area in the vicinity of the first cleaning holder 511. The both ends of the second cleaning holder 512 engage with the guide members 61*c* and 61*d*, respectively, similar to the structure of the first cleaning holder 511. FIG. 5 is a partial sectional view illustrating an end portion of the first cleaning holder 511 where the cleaning member 53*a* is held. Only the structure of the first cleaning holder 511 will be described below, but the second cleaning holder 512 has the same structure as that of the first cleaning holder 511 in the present exemplary embodiment.

As illustrated in FIGS. 4 and 5, the guide members 61*a* to 61*d* are integrally formed with the cover portion 40*b*, and protrude upward from the top surface of the cover portion 40*b*.

As illustrated in FIG. 5, the guide members 61*a* to 61*d* each include a first projection 61*aa* and a second projection blab. The first projection 61*aa* protrudes upward with respect to the top surface of the cover portion 40*b*. The second projection blab extends from the first projection 61*aa* in a direction away from the cleaning member 53*a*.

One end portion 511*a* of the first cleaning holder 511 is formed below the second projection 61*ab*. The end portion 511*a* includes an abutting portion which is formed in an arc-like shape, and abuts against the second projection 61*ab*. Thus, the formation of the end portion 511*a* in an arc-like shape makes it possible to reduce a sliding resistance during the movement of the first cleaning holder 511 in the direction of the arrow D1 or in the direction of the arrow D2 (refer to FIG. 3).

In the present exemplary embodiment, only the structure at one end of the first cleaning holder 511 is described in detail. However, the structure at the other end of the first cleaning holder 511 is the same as the structure at one end of the first cleaning holder 511. The second cleaning holder 512 has the same shape as that of the first cleaning holder 511.

The first cleaning holder 511 and the second cleaning holder 512 engage with the guide members 61*a* to 61*d*, thereby preventing the cleaning members 53*a* to 53*d* held by the first cleaning holder 511 and the second cleaning holder 512 from being spaced apart from the transmission members 42*a* to 42*d*. In this case, the position where the first cleaning holder 511 and the second cleaning holder 512 engage with the guide members 61*a* to 61*d* is a position where the cleaning members 53*a* to 53*d* are in contact with the transmission members 42*a* to 42*d*, respectively, at a predetermined contact pressure.

In the present exemplary embodiment, the guide members 61*a* to 61*d* and the first and second stoppers 56*a* and 56*b* are integrally formed with the cover portion 40*b* by using a resin. However, they may be formed separately from the cover portion 40*b*.

In the present exemplary embodiment as described above, the first cleaning holder 511 and the second cleaning holder 512 are moved in the direction of the arrow D1 or in the direction of the arrow D2 during the cleaning process, thereby making it possible to clean the top surface of each of the transmission members 42*a* to 42*d*. This cleaning sequence is periodically executed when a cleaning execution instruction is received at any timing from the operator through the operation portion 304 or the like, or when the cumulative number of sheets on which the image forming operation is performed reaches a predetermined number.

In this case, the predetermined number of sheets on which the cleaning sequence is periodically executed is preliminarily set to, for example, 10,000, as a default setting. In this default setting, the operator can change the setting for the predetermined number of sheets on which the cleaning sequence is executed by, for example, inputting a value "500" through the operation portion 304. The predetermined number set in this case is an example for a first predetermined value.

Next, an image density adjustment sequence for adjusting a density of an image according to the present exemplary embodiment will be described.

The image forming apparatus 1 controls the density of an image to be formed based on the intensity of the amount of laser light emitted from the optical scanning device 40.

Even when a constant amount of laser light is emitted from the optical scanning device 40, the amount of electric charge of toner changes depending on a water content in air, so that the density of the image changes. Accordingly, the density of the image needs to be adjusted to control the density of an image, which is to be formed by the image forming apparatus 1, to be constant. In the present exemplary embodiment, the image density adjustment sequence is thus executed to adjust the image density. The image density adjustment sequence is a sequence for setting the amount of laser light to obtain an appropriate image density even when the image formation speed of the image forming apparatus 1 is changed, or when the environment in which the image forming apparatus 1 is installed is changed. The amount of laser light is an example of an image formation condition for forming a toner image on each photosensitive member 100.

According to the present exemplary embodiment, a density detection toner pattern is formed on the intermediate transfer belt 20 by the image forming portion 10 and the optical scanning device 40, in the image density adjustment sequence. The density of the toner pattern is detected by a density detection sensor, and then the amount of laser light is adjusted to obtain an appropriate density. The density detection sensor is an example of a density detection unit.

Figure 6:
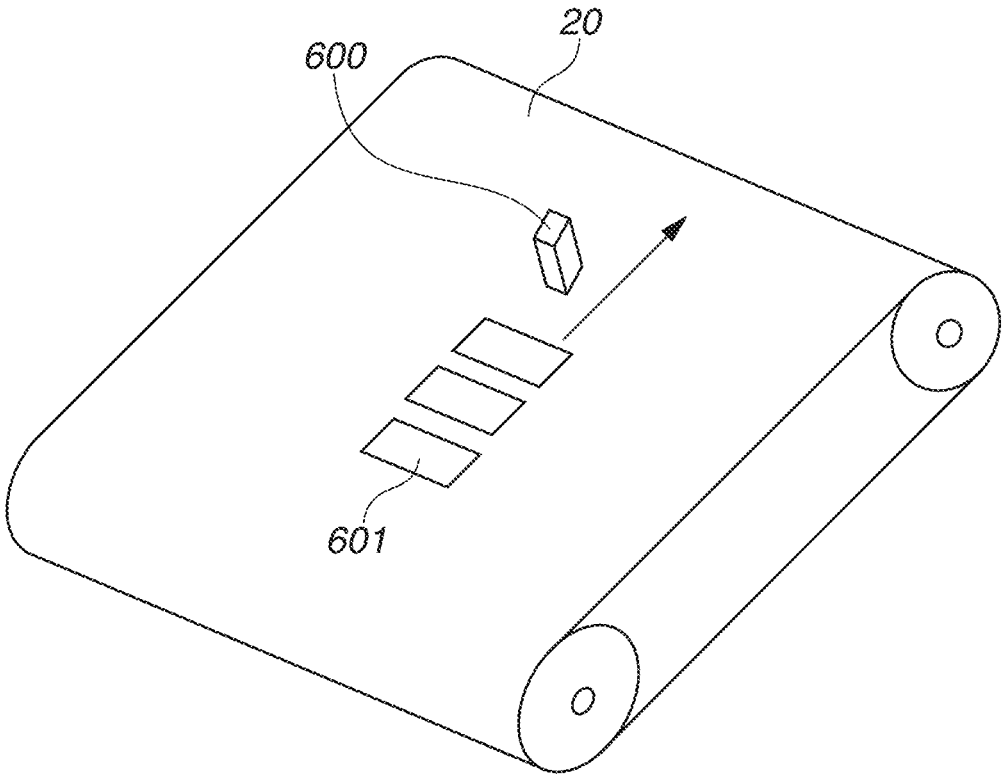
FIG. 6 illustrates a structure in which a density detection sensor detects a toner pattern on an intermediate transfer belt.
Figure 7A:
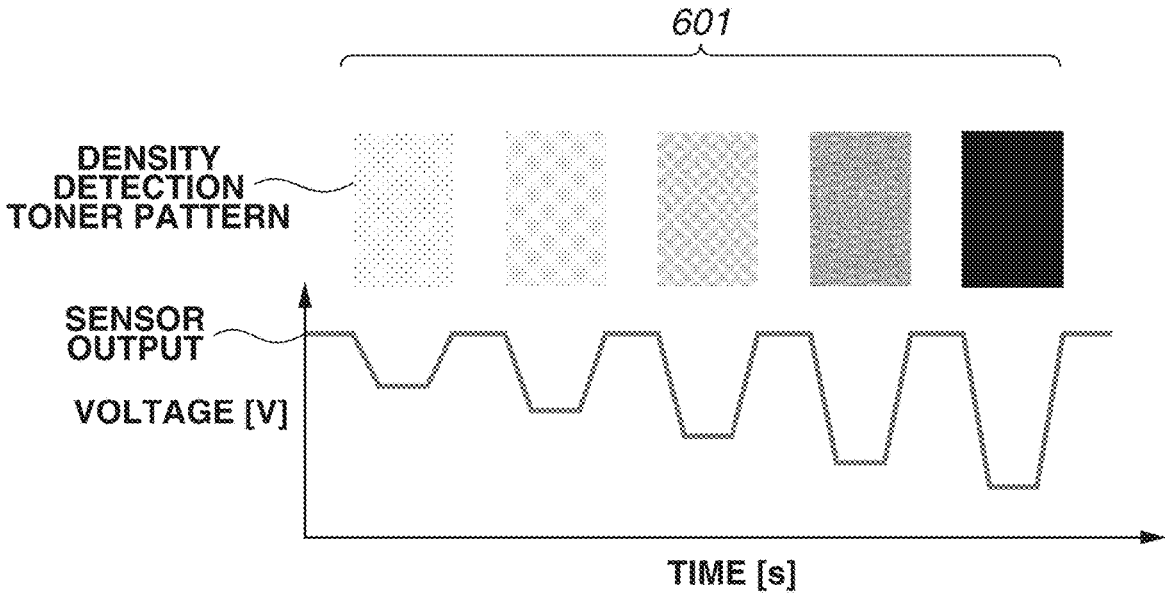
FIGS. 7A and 7B are diagrams illustrating detection results from the density detection sensor.
Figure 7B:
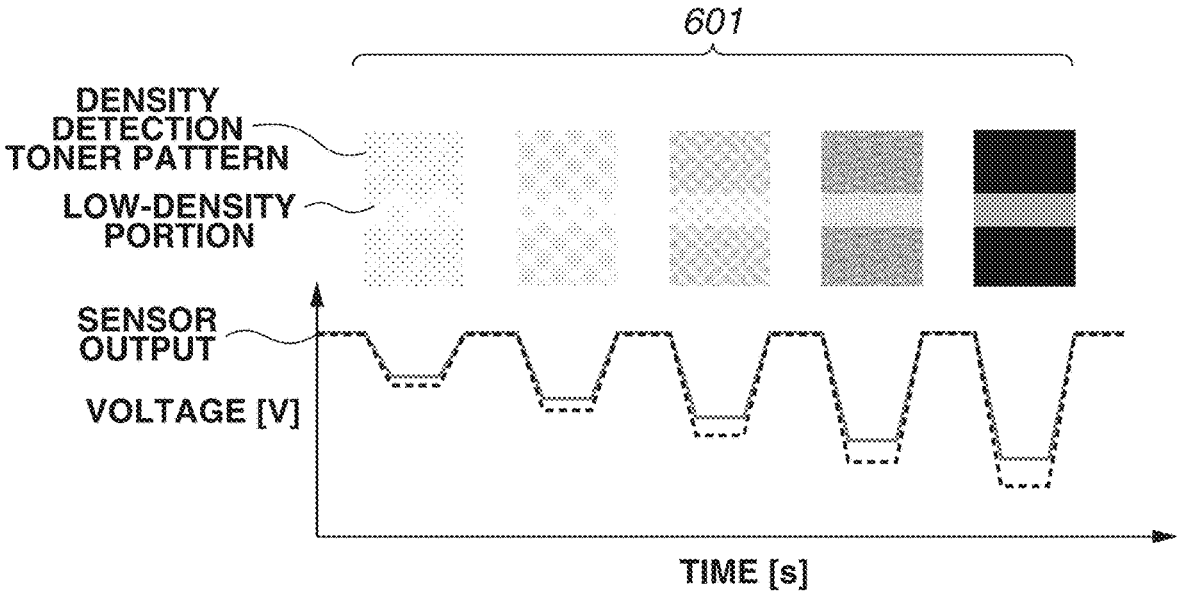

Specifically, a density detection toner pattern 601 is formed on the intermediate transfer belt 20 by the image forming portion 10 and the optical scanning device 40, as illustrated in FIG. 6. If exposure and development processes are performed by changing the amount of laser light emitted from the optical scanning device 40, the density detection toner pattern 601 with different densities is formed as illustrated in FIGS. 7A and 7B. The density detection toner pattern 601 conveyed by the intermediate transfer belt 20 is measured by a toner density detection sensor 600. And thus a laser light amount set value as a target density is calculated based on the laser light amount set value and the detected toner density.

The toner density detection sensor 600 illustrated in FIG. 6 is composed of, for example, a light-emitting element as a light emitting diode (LED) and a light-receiving element as a photodetector (PD). The density detection toner pattern 601 is irradiated with light from the LED, and a density is detected based on an output voltage obtained when positively-reflected light is received by the PD.

Next, a detection result from the toner density detection sensor 600 will be described with reference to FIGS. 7A and 7B. As illustrated in FIGS. 7A and 7B, a voltage output value increases as the density of the density detection toner pattern 601 decreases. The voltage output value decreases as the density of the density detection toner pattern 601 increases. FIG. 7A illustrates an output voltage from the toner density detection sensor 600 when the density detection toner pattern 601 is detected in a normal state. FIG. 7B illustrates an output voltage from the toner density detection sensor 600 when the density detection toner pattern 601 is detected in an abnormal state.

When the image density adjustment sequence is executed, the density detection toner pattern 601 is formed by gradually increasing the amount of laser light from left to right in FIG. 7A, i.e., from a low light amount to a high light amount, so that the density detection toner pattern 601 is formed such that the density gradually increases from left to right in FIG. 7A. The density detection toner pattern 601 conveyed by the intermediate transfer belt 20 is then measured by the toner density detection sensor 600. The laser light amount set value indicating the target density is calculated based on the laser light amount set value and the detected toner density.

If a foreign substance, such as toner, adheres to the transmission members 42*a* to 42*d*, the laser light is blocked by the foreign substance, so that the amount of light to be applied to each photosensitive member 100 decreases. Thus, the density in a part of the density detection toner pattern 601 may decrease, as illustrated in FIG. 7B. Accordingly, an output voltage (indicated by a solid line) from each density detection toner pattern 601 measured by the toner density detection sensor 600 is lower than an output voltage (indicated by a broken line) obtained when the density detection toner pattern 601 is detected in the normal state illustrated in FIG. 7A. Therefore, if the laser light amount set value is calculated using a density detection value indicated by a solid line in FIG. 7B, an difference is caused, unlike in a case where the laser light amount set value is calculated using a density detection value indicated by a broken line in FIG. 7B. This difference in the light amount value makes it difficult to obtain a normal image density.

In the structure described above, the toner density detection sensor 600 is used to read the density detection toner pattern 601. Alternatively, another structure may be employed, in which the density detection toner pattern 601 is formed on a sheet and the density of the formed density detection toner pattern 601 is read by the document reading device 305.

Figure 8:
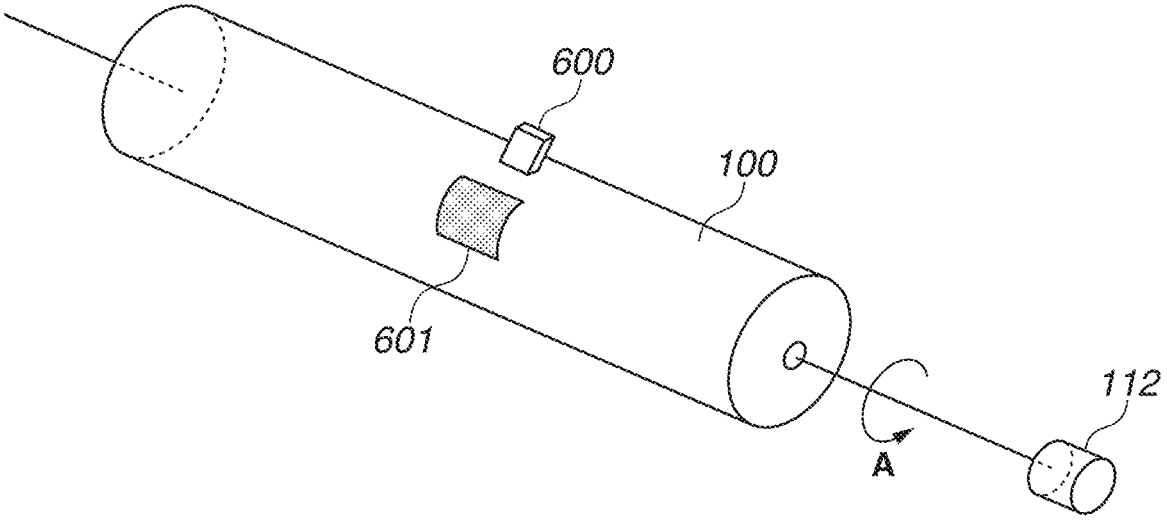
FIG. 8 is a diagram illustrating a structure in which the density detection sensor detects a toner pattern on a photosensitive member.

The exemplary embodiment described above illustrates a method in which the density of the density detection toner pattern 601 on the intermediate transfer belt 20 is detected. However, it is also possible to employ a method in which the density detection toner pattern 601 is formed on the photosensitive member 100 driven by a photosensitive member motor 112 as illustrated in FIG. 8, and the toner pattern 601 is read by the toner density detection sensor 600 that is located near the photosensitive member 100. In this case, the density of the density detection toner pattern 601 and the output voltage obtained when the density detection toner pattern 601 is detected by the toner density detection sensor 600 are similar to those illustrated in FIGS. 7A and 7B. Specifically, the output voltage decreases as the density increases, and a difference between an output voltage from a portion where the density detection toner pattern 601 is present and an output voltage from a portion where the density detection toner pattern 601 is not present increases. The toner density detection sensor 600 is an example of a toner density detection unit.

Figure 9:
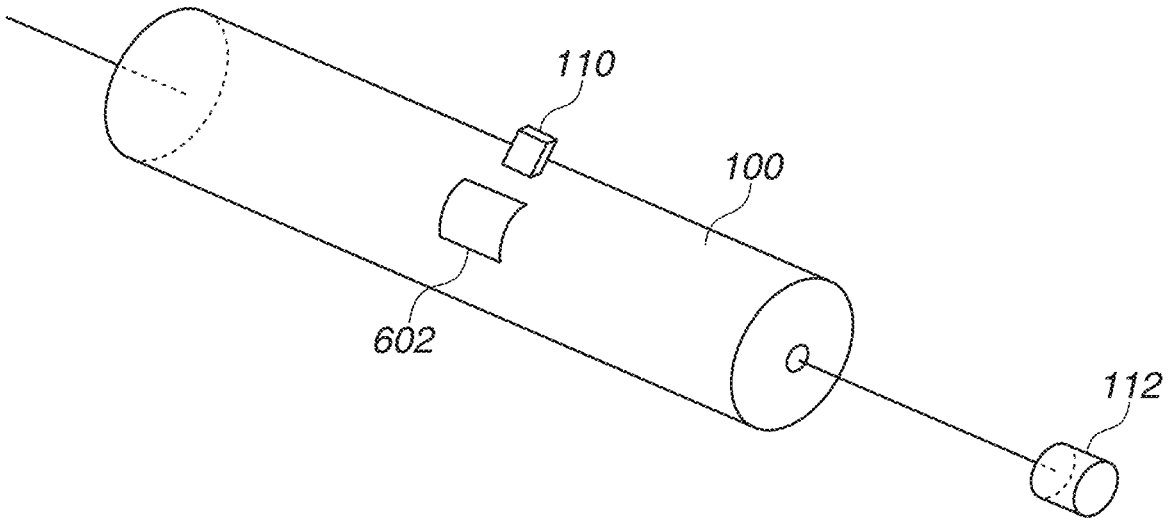
FIG. 9 is a diagram illustrating a structure in which a potential sensor detects a potential of a density adjustment latent image pattern.

It is also possible to employ a method in which, as illustrated in FIG. 9, laser light is emitted from the optical scanning device 40 to form a density adjustment latent image pattern 602 on the photosensitive member 100, and the potential of the density adjustment latent image pattern 602 is detected by a potential sensor 110 located near the photosensitive member 100.

FIG. 9 illustrates the density adjustment latent image pattern 602, for convenience of illustration. However, in practice, only the potential of the photosensitive member 100 is different from the potential of the other portion, and thus the shape of the density adjustment latent image pattern 602 cannot be visually observed.

Figure 10:
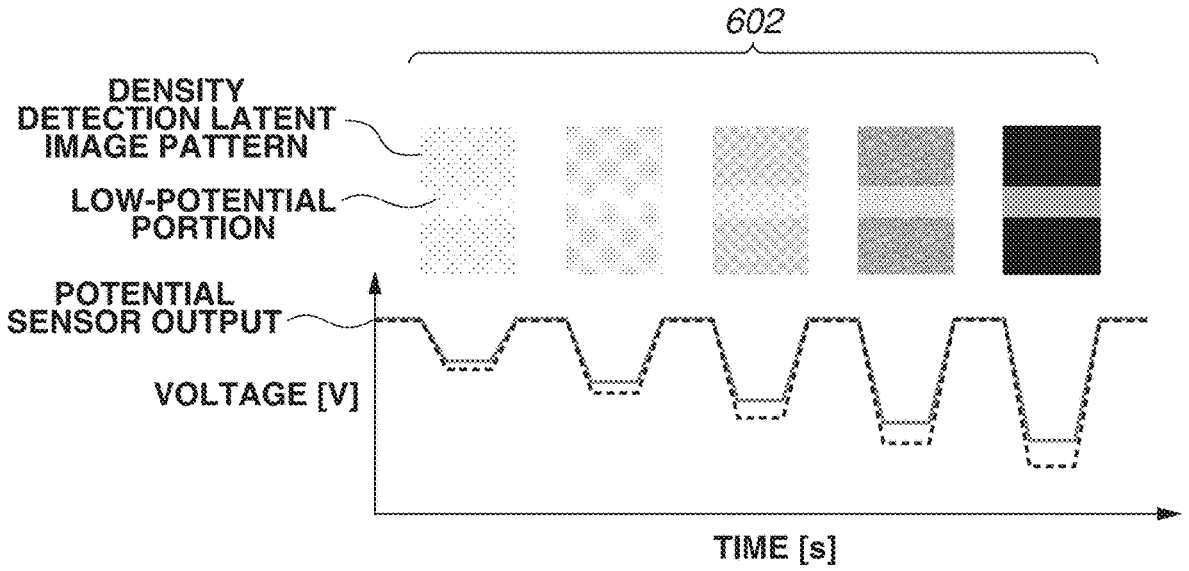
FIG. 10 illustrates a detection result from the potential sensor.

FIG. 10 illustrates a detection result obtained when the density adjustment latent image pattern 602 illustrated in FIG. 9 is detected by the potential sensor 110. FIG. 10 schematically illustrates a latent image pattern, assuming that a difference between a latent image potential of an exposure portion and a latent image potential of a non-exposure portion increases as the density of the pattern increases during the toner using development process. The potential sensor 110 is an example of a potential detection unit.

In the case of detecting a pattern using the potential sensor 110, an output voltage obtained from the potential sensor 110 is high in the non-exposure portion, and an output voltage obtained from the potential sensor 110 decreases as the amount of light for generating a latent image increases, so that a potential difference between the exposure portion and the non-exposure portion increases. The potential of each density adjustment latent image pattern is measured by the potential sensor 110, and the amount of laser light and the charging potential of the photosensitive member 100 are adjusted to obtain a potential difference required for an appropriate density, thereby performing the image density adjustment sequence.

As described above, in a case where the latent image pattern 602 is formed and the image density adjustment sequence is performed based on the potential detected from the latent image pattern 602, the laser light emitted from the optical scanning device 40 is blocked by a foreign substance, such as toner and paper dust, during formation of the latent image pattern 602, if the foreign substance adheres to the surface of the transmission members 42*a* to 42*d*. Thus, since the amount of light to be applied to the photosensitive member 100 decreases, the potential of each pattern and the amount of toner may decrease only in an area where the laser light is blocked by the foreign substance as illustrated in FIG. 10.

Accordingly, the detection result (e.g., output voltage) from the potential sensor 110 changes. In FIG. 10, the detection result obtained in the normal state is indicated by a broken line. The detection result obtained in the abnormal state in which the foreign substance is present on the transmission member 42 is indicated by a solid line.

When the foreign substance is present on the transmission member 42, a variation of the detected voltage (indicated by a solid line) from each density adjustment latent image pattern 602 measured by the potential sensor 110 in the non-exposure area decreases as compared with a voltage (indicated by a dotted line) illustrated in FIG. 10. Thus, a difference is caused in the laser light amount value obtained based on the relationship between the density detection value and the amount of laser light. This difference in the light amount value makes it difficult to obtain a normal image density.

According to the present exemplary embodiment, a structure is provided that is capable of executing the cleaning sequence described above during execution of the image density adjustment sequence. More specifically, it is possible to provide a structure that is capable of executing the cleaning sequence before forming the density adjustment pattern in the image density adjustment sequence. With this structure, the density adjustment pattern can be formed by laser light emitted from an outlet in a state where the foreign substance on the transmission member 42 is removed. Consequently, an appropriate density adjustment can be performed.

The present exemplary embodiment performs, as described above, cleaning sequence using the cleaning mechanism 51 every predetermined cleaning setting number that is preliminarily set.

As described above, in the structure in which the cleaning sequence can be executed before executing the image density adjustment sequence and the cleaning sequence is executed every time the cumulative number of sheets on which the image forming operation is performed reaches a predetermined number, the cleaning sequence may be continuously executed, for example, when the image density adjustment sequence is executed immediately before the cumulative number of sheets on which the image forming operation is performed reaches the predetermined number.

More specifically, the cleaning sequence is executed again when the cumulative number of sheets on which the image forming operation is performed becomes 10,000 after the image forming operation is performed on one sheet, in a case where the predetermined number of sheets on which the cleaning sequence is periodically executed is set to 10,000 and the image density adjustment sequence and the cleaning sequence associated with the image density adjustment sequence are executed when the cumulative number of sheets on which the image formation operation is performed is 9,999. In this case, an unnecessary cleaning sequence is carried out, which may lead to an increase in downtime when the image forming operation and the like cannot be performed on sheets and lead to impairment in usability.

According to the present exemplary embodiment, in view of the above-described circumstances, it is possible to provide a structure that is capable of executing the cleaning sequence during execution of the image density adjustment sequence and preventing usability from being impaired even when the cleaning sequence can be executed on a predetermined number of sheets. A control sequence according to the present exemplary embodiment will be described below with reference to FIGS. 11 and 12.

Figure 11:
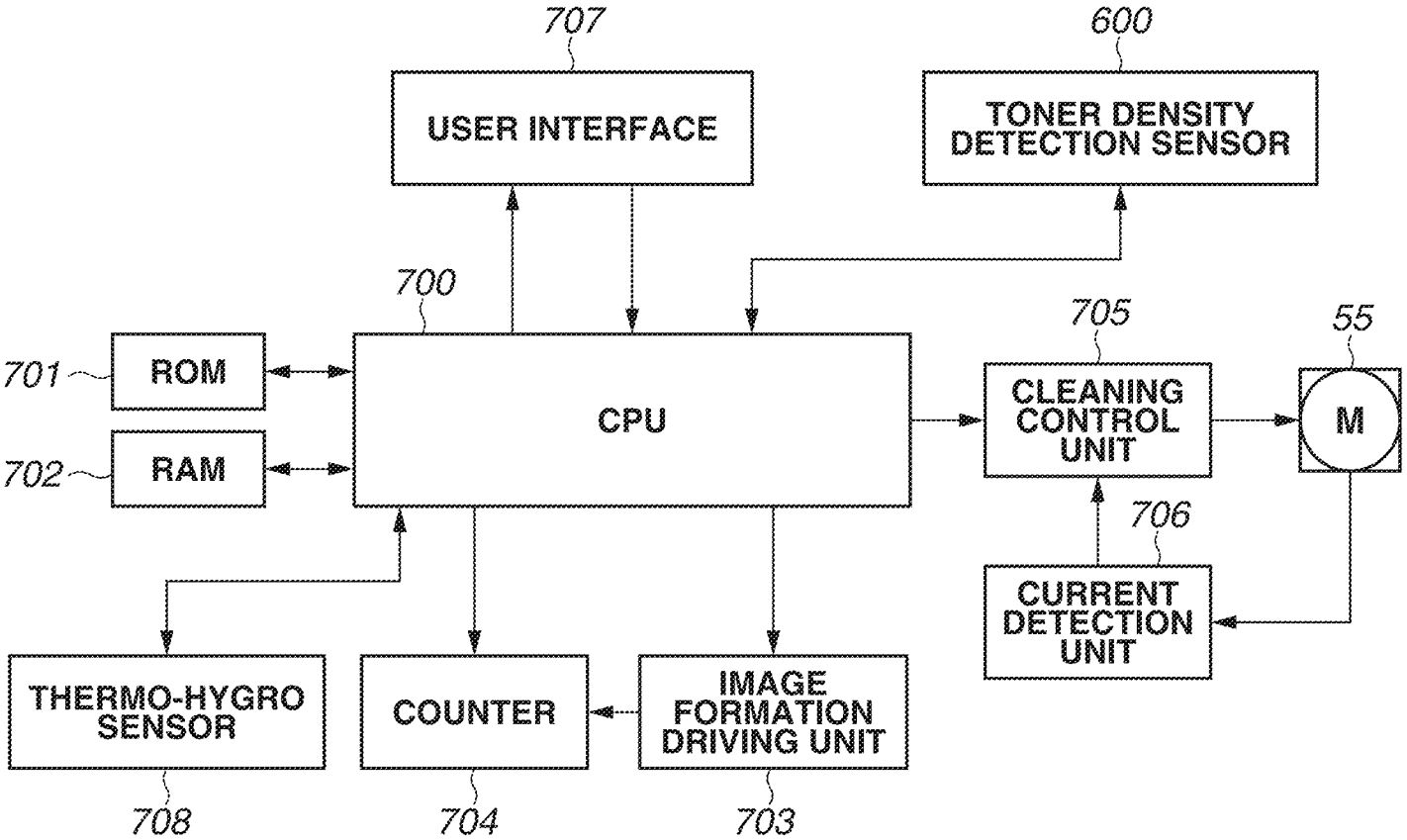
FIG. 11 illustrates a control block diagram for controlling the image forming apparatus.
Figure 12:
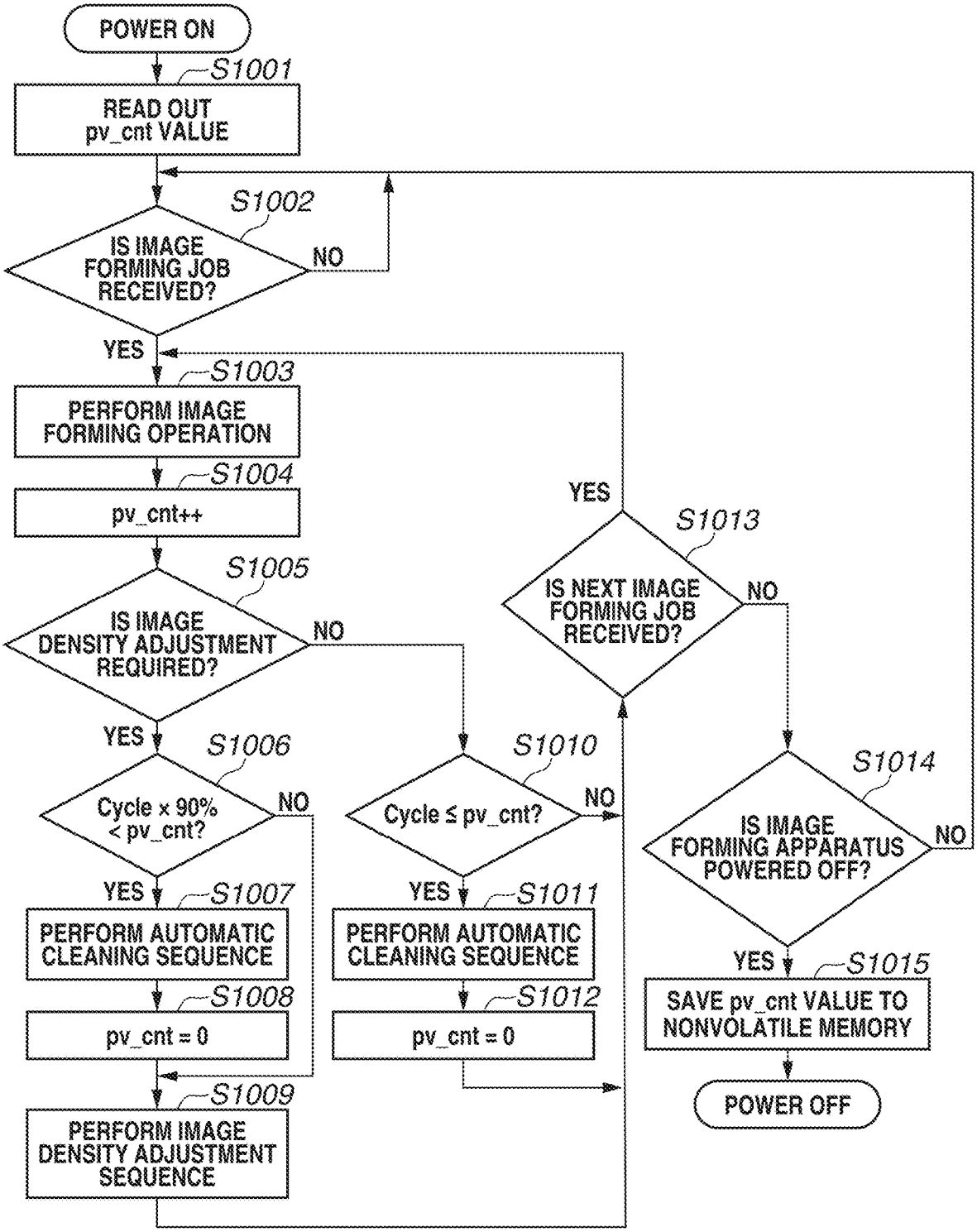
FIG. 12 illustrates a flowchart of a control sequence.

FIG. 11 is a control block diagram for controlling the image forming apparatus 1. FIG. 12 is a flowchart illustrating the image density adjustment sequence and the cleaning sequence according to the present exemplary embodiment.

As illustrated in FIG. 11, the CPU 700 is configured to control the winding motor 55, the image forming portions 10, the optical scanning device 40, and the like through each module. The CPU 700 reads out a firmware program stored in a read-only memory (ROM) 701 and a boot program for controlling the firmware program. The CPU 700 uses the RAM 702 as a work area and a temporary storage area for storing data, and executes various control operations. The CPU 700 is an example of a control unit.

The CPU 700 can control a user interface 707 that receives an instruction from the operator through the operation portion 304. The CPU 700 can acquire setting information about an image formation job and the like from the operator through the user interface 707, and can notify the operator of various information. In the operation portion 304, a liquid crystal display panel and a resistive or capacitive touch panel are stacked.

The CPU 700 stores (accumulates) the image formation job received from the operator through the user interface 707 in the RAM 702, and controls an image formation driving unit 703 based on the image formation job stored in the RAM 702 in response to a job execution instruction or the like from the user, thereby executing the image formation job.

Further, the CPU 700 stores the image formation job received via a network line (not illustrated) in the RAM 702, and controls the image formation driving unit 703 based on the image formation job stored in the RAM 702, thereby executing the image formation job.

The CPU 700 stores the image formation jobs in a reception order in the RAM 702, when receiving a plurality of image formation jobs through the operation portion 304 or the network line (not illustrated). Based on a storage order, the CPU 700 controls the image formation driving unit 703 to sequentially execute the plurality of image formation jobs.

The user interface 707 is configured to be operable by the operator through a touch panel based on a display on a display panel. An image forming operation execution timing can be set by the operator via the user interface 707.

In this case, a cleaning operation execution timing is determined by a set value (or an initial value for a cleaning set value preliminarily stored in the RAM 702) or the like that is set by the operator through the user interface 707 and stored in the RAM 702. The set value is an example of the predetermined number.

The CPU 700 controls the image forming portions 10 and the optical scanning device 40 through the image formation driving unit 703, outputs an image formation signal every time the image forming operation is performed on a sheet, and causes a counter 704 to count the number of sheets on which the image forming operation is performed.

The counter 704 outputs the count value to the CPU 700. The CPU 700 stores, as needed, the received count value as the cumulative number of recording media on which the image forming operation is performed in the RAM 702.

The CPU 700 compares the count value obtained by the counter 704 with the cleaning set value stored in the RAM 702. When the count value is more than or equal to a predetermined cleaning set value stored in the RAM 702, the CPU 700 outputs a cleaning execution instruction to a cleaning control unit 705. Specifically, in a case where the cleaning set value is 2,000, the CPU 700 outputs the cleaning execution instruction when the count value held in the counter 704 indicates 2,000. When the CPU 700 executes the cleaning process, the CPU 700 sets the count value of the counter 704 to zero to reset the count value. The image formation signal output from the image formation driving unit 703 to the counter 704 is output once when the image forming operation is performed on one side of a sheet.

The image formation signal is output twice when the image forming operation is performed on both sides of a sheet. The counter 704 increments the count value one by one every time the image formation signal is received.

The CPU 700 outputs a motor control signal to the winding motor 55 through a cleaning control unit 705, thereby rotationally drives the winding motor 55. Thus, the CPU 700 can operate the winding motor 55 through the cleaning control unit 705. On the other hand, the CPU 700 detects a motor drive current from the winding motor 55 through a current detection unit 706 during the cleaning sequence.

The winding motor 55 is controlled with a constant voltage. When the first cleaning holder 511 or the second cleaning holder 512 abuts against the first stopper 56*a* or the second stopper 56*b*, the drive current increases as the load on the winding motor 55 increases.

The CPU 700 detects that the first cleaning holder 511 or the second cleaning holder 512 abuts against the first stopper 56*a* or the second stopper 56*b* and that the movement of the transmission members 42*a* to 42*d* in one direction from one end to another end is completed, when the drive current detected by the current detection unit 706 is more than a predetermined value. Thus, the CPU 700 detects completion of a one-way cleaning process in a reciprocating operation.

Accordingly, the CPU 700 outputs a movement completion signal to the cleaning control unit 705 upon detecting that the drive current is more than the predetermined value. Upon receiving the movement completion signal, the cleaning control unit 705 stops rotational driving of the winding motor 55.

The term "predetermined value" used herein refers to a value that is greater than the value of the drive current that flows through the winding motor 55 while the first cleaning holder 511 or the second cleaning holder 512 moves on the transmission members 42*a* to 42*d*. Specifically, the predetermined value is a value that is greater than the value of the drive current that flows through the winding motor 55 before the first cleaning holder 511 or the second cleaning holder 512 abuts against the first stopper 56*a* or the second stopper 56*b*.

In other words, the predetermined value is a value with which the abutment of the first cleaning holder 511 or the second cleaning holder 512 against the first stopper 56*a* or the second stopper 56*b* can be detected and which does not include a current value that increases due to a variation caused by such a motor failure.

A determination as to whether the movement of the first cleaning holder 511 and the second cleaning holder 512 in the longitudinal direction of the transmission members 42*a* to 42*d* from one end to another end is completed may be made by determining a variation in the detected current value, instead of comparing the current value with the predetermined value.

When it is determined that the cleaning operation is completed, the CPU 700 stops the winding motor 55 through the cleaning control unit 75, and outputs a cleaning completion notification to the user interface 707. The user interface 707 displays information indicating that the cleaning operation is completed on the operation portion 304 based on the cleaning completion notification, thereby notifying the user of completion of the cleaning operation. The notification indicating that the cleaning operation is completed may be performed by making sound, instead of displaying a screen on a display unit. If the user feels the notification bothersome, the notification may be omitted.

On the other hand, when it is determined that the cleaning operation is not completed, the CPU 700 outputs the cleaning execution instruction again to the cleaning control unit 705, and controls the winding motor 55 through the cleaning control unit 705 to continue the cleaning operation. The cleaning control unit 705 causes the winding motor 55 to be rotated forwardly or reversely, thereby making it possible to control the first cleaning holder 511 and the second cleaning holder 512 to perform a reciprocating operation.

The CPU 700 determines whether the image density adjustment sequence is carried out based on a change in the water content in air detected by a thermo-hygro sensor 708 built-in the image forming apparatus 1.

For example, when a detection result from the thermo-hygro sensor 708 indicates that the temperature is 0° C. and the humidity is 20%, the water content in air is about 1.0 g/kgDA (i.e., water content of 1.0 g in 1 kg of air). When the detection result indicates that the temperature is 36° C. and the humidity is 90%, the water content in air is about 37.5 g/kgDA. Thus, an execution signal for instructing to execute the image density adjustment sequence is generated, when the range of the water content obtained based on the detection result from the thermo-hygro sensor 708 is divided into, for example, eight areas and the water content is changed by about 4.6 g/kgDA or more from that in the previous image density adjustment. Alternatively, the execution signal for instructing to execute the subsequent mage density adjustment sequence is generated, when the image forming operation is performed by the image forming portions 10 on a predetermined number of sheets (e.g., 5,000 sheets) from the previous image density adjustment sequence. A predetermined number, which is set as a predetermined count value when the image density adjustment sequence is executed, is less than the predetermined number, which is set when the cleaning sequence is executed. This is because the frequency of occurrence of change in the environment in which the density of an image to be formed changes is higher than the frequency at which a foreign substance falls onto the transmission members 42*a* to 42*d*. The predetermined number is an example of a second predetermined value.

When an image density adjustment sequence execution signal is generated, the CPU 700 controls the cleaning control unit 705 to execute the cleaning sequence described above before forming the density adjustment pattern. Upon completion of the cleaning sequence, the CPU 700 resets the count value held in the counter 704 and controls the optical scanning device 40, the image forming portions 10, and the intermediate transfer belt 20 to form the density adjustment pattern on the intermediate transfer belt 20 or each photosensitive member 100. After that, the toner density detection sensor 600 or the potential sensor 110 is used to detect the density adjustment pattern.

The CPU 700 detects the density of the density adjustment pattern from the output voltage of the detection result from the toner density detection sensor 600 or the potential sensor 110. The CPU 700 then calculates the laser light amount set value as the target density using the laser light amount set value and the density of the pattern based on the detected output voltage. The CPU 700 uses the calculated laser light amount set value to control the image formation driving unit 703 while forming an image on a sheet.

In the present exemplary embodiment, the phrase "before formation of the density adjustment pattern" indicates a state before laser light for forming a pattern is emitted from the optical scanning device 40.

If the cleaning sequence is executed every time when the image density adjustment sequence is executed, the cleaning sequence may possibly be executed too much. Thus, in the present exemplary embodiment, the cleaning sequence is executed when the image density adjustment sequence execution signal is generated and when the count value of the counter 704 is more than to 90% of the cleaning set value (predetermined number). Accordingly, the image forming operation is executed to some extent after execution of the previous cleaning sequence, and the cleaning sequence is executed when it is highly possible that a foreign substance is present on the transmission members 42*a* to 42*d*.

Next, the control sequence to be performed by the CPU 700 according to the present exemplary embodiment will be described with reference to a flowchart illustrated in FIG. 12.

In step S1001, the CPU 700 reads out the current count value (=pv_cnt value) from the counter 704. In step S1002, the CPU 700 checks whether an image formation job is received through the user interface 707. If the image formation job is not received (NO in step S1002), the processing proceeds back to step S1002, and the CPU 700 maintains the state of step S1001.

If the image formation job is received (YES in step S1002), the processing proceeds to step S1003. In step S1003, the CPU 700 controls the image formation driving unit 703 to execute the image forming operation. In step S1004, the counter 704 that has received a count signal from the image formation driving unit 703 is counted up.

In step S1005, the CPU 700 determines whether the image density adjustment is required. As described above, the CPU 700 determines whether the image density adjustment sequence is required, for example, when it is determined that the water content in air is changed based on the detection result from the thermo-hygro sensor 708 built-in the image forming apparatus 1, or when the image forming operation has been executed on a predetermined number of sheets (e.g., 5,000 sheets) after the previous image density adjustment, as described above. When the CPU 700 determines that the image density adjustment is required, the CPU 700 generates the image density adjustment sequence execution signal.

When the CPU 700 generates the image density adjustment sequence execution signal (YES in step S1005), the processing proceeds to step S1006. In step S1006, the CPU 700 compares the cleaning set value (defined as "Cycle" in the flowchart illustrated in FIG. 12) preliminarily stored in the RAM 702 with the current count value. If a value obtained by multiplying a predetermined coefficient by the cleaning set value satisfies, for example, Cycle×90% is less than pv_cnt (YES in step S1006), the processing proceeds to step S1007. In step S1007, the cleaning sequence is executed. In step S1008, the count value of the counter 704 is reset to "0". In this case, the coefficient is multiplied by the cleaning set value, but instead a predetermined value may be added/subtracted.

In step S1009, the CPU 700 executes the image density adjustment sequence described above after executing the cleaning sequence.

On the other hand, if Cycle×90% is not less than pv_cnt (NO in step S1006), the processing proceeds to step S1009, without performing the cleaning sequence. In step S1009, the CPU 700 performs the image density adjustment sequence. In step S1013, the CPU 700 determines whether the next image formation job is received.

When the CPU 700 does not generate the image density adjustment sequence execution signal (NO in step S1005) and when the current count value is more than or equal to the cleaning set value preliminarily stored in the RAM 702 (YES in step S1010), the processing proceeds to step S1011. In step S1011, the CPU 700 performs the cleaning sequence, and resets, in step S1012, the count value of the counter 704 to "0". In step S1013, the CPU 700 determines whether the next image formation job is received.

When the CPU 700 receives the next image formation job (YES in step S1013), the processing proceeds to step S1003 to continue the processing flow described above. When the next image formation job is not received (NO in step S1013), the processing proceeds to step S1014. In step S1014, the CPU 700 determines whether the image forming apparatus 1 is powered off. When the image forming apparatus 1 is not powered off (NO in step S1014), the processing proceeds to step S1002 to continue the processing flow described above. When the image forming apparatus 1 is powered off (YES in step S1014), the processing proceeds to step S1015. In step S1015, the CPU 700 stores the current value obtained by the counter 704 in the RAM 702. The cleaning process in the flowchart illustrated in FIG. 12 is then terminated.

In step S1014, the CPU 700 determines whether the image forming apparatus 1 is powered off. However, it may be determined whether the image forming apparatus 1 shifts to a power saving mode. In this case, when the image forming apparatus 1 shifts to the power saving mode, the processing proceeds to step S1015, and when the image forming apparatus 1 does not shift to the power saving mode, the processing returns to step S1002.

By using the processing flow described above, even in the structure in which the cleaning sequence is executed before formation of the density adjustment pattern in the image density adjustment sequence and the cleaning sequence is executed every time the number of sheets on which the image forming operation is performed reaches the predetermined number, it is possible to prevent an increase in downtime and impairment in usability due to continuous execution of the cleaning sequence.

Further, cleaning of the transmission members 42*a* to 42*d* before formation of the density adjustment pattern in the image density adjustment sequence makes it possible to prevent occurrence of a defect in a toner pattern during the image density adjustment and to accurately perform the image density adjustment sequence. On the other hand, even if the density adjustment timing and the automatic cleaning time are temporarily close to each other, an automatic cleaning operation to be performed before the image density adjustment and an automatic cleaning operation to be performed every predetermined number of sheets on which the image forming operation is performed are collectively performed to thereby minimize an increase in downtime.

In the present exemplary embodiment described above, it is determined that the cleaning sequence is required, in the case of generating the image density adjustment sequence execution signal, when the count value is more than or equal to 90% of the cleaning set value. However, the cleaning sequence may be executed every time when the image density adjustment sequence execution signal is generated, without comparing the count value with the cleaning set value. Even with this structure, the count value of the counter 704 is reset when the cleaning sequence is completed after the density adjustment sequence execution signal is generated. Accordingly, it is possible to prevent the cleaning sequence from being executed frequently.

In the exemplary embodiment described above, the optical scanning device 40 is provided vertically below the image forming portions 10. However, the optical scanning device 40 may be provided vertically above the image forming portions 10. In this structure, the transmission members 42*a* to 42*d* are provided above the image forming portions 10, and thus a foreign substance, such as toner and paper dust, does not fall onto the transmission members 42*a* to 42*d* from the image forming portions 10. However, there is a possibility that scattered toner or paper dust may adhere to the transmission members 42*a* to 42*d*. Therefore, even in the structure in which the optical scanning device 40 is provided vertically above the image forming portions 10, the provision of the cleaning mechanism 51 makes it possible to remove a foreign substance such as toner and paper dust adhering to the transmission members 42*a* to 42*d*.

In the exemplary embodiment described above, the counter 704 increments the count value one by one based on information received from the CPU 700 that indicates the number of sheets on which the image forming operation has been performed. However, the counter 704 may subtract the count value one by one based on the information about the number of sheets on which the image forming operation has been performed. In this case, the count value may be subtracted from a set cleaning setting number, and a cleaning setting number, such as "−1000", may be set. It may also be determined whether the cleaning setting number is reached based on the absolute value of the count value obtained by the counter 704.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-036674, filed Feb. 28, 2019, which is hereby incorporated by reference herein in its entirety.

What is claimed is:

1. An image forming apparatus configured to form an image on a sheet, the image forming apparatus comprising:

an image forming unit including a photosensitive member, an optical scanning device including a transmission member configured to cause laser light for scanning the photosensitive member to pass through the transmission member to an outside of the optical scanning device, and a developing device configured to develop an electrostatic latent image with toner, the electrostatic latent image being formed by the laser light on the photosensitive member;

a cleaning mechanism configured to clean the transmission member; and a control unit configured to execute a cleaning sequence for causing the cleaning mechanism to clean the transmission member in a case where a number of sheets on which respective image forming operations has been performed by the image forming unit since the last cleaning sequence by the cleaning mechanism was executed is more than a first predetermined value;

generate an execution signal to execute an adjustment sequence for causing the image forming unit to adjust an image formation condition for forming the toner image on the photosensitive member, wherein, (i) in a case where the execution signal is generated and a number of sheets on which respective image forming operations has been performed by the image forming unit since the last cleaning sequence by the cleaning mechanism was executed is more than a second predetermined value, the control unit performs a control to execute the adjustment sequence after the cleaning sequence is executed, and (ii) in a case where the execution signal is generated and a number of sheets on which respective image forming operations has been performed by the image forming unit since the last cleaning sequence by the cleaning mechanism was executed is less than or equal to the second predetermined value, the control unit performs the control to execute the adjustment sequence without executing the cleaning sequence, and wherein the second predetermined value is less than the first predetermined value.

2. The image forming apparatus according to claim 1, wherein the control unit executes the cleaning sequence in response to the execution signal, emits laser light from the optical scanning device upon completion of the cleaning sequence, and forms an adjustment pattern on the photosensitive member.

3. The image forming apparatus according to claim 1, further comprising:

a transfer member configured to transfer a toner image to the sheet; and a density detection unit configured to detect a density of the toner image transferred by the transfer member, wherein the control unit forms an adjustment pattern on the photosensitive member, causes the developing device to develop the adjustment pattern during the adjustment sequence, controls the image forming unit to cause the transfer member to transfer the developed adjustment pattern, and adjusts an amount of laser light emitted from the optical scanning device based on the density of the developed adjustment pattern detected by the density detection unit.

4. The image forming apparatus according to claim 1, further comprising a toner density detection unit configured to detect a density of the toner image formed on the photosensitive member, wherein the control unit controls the image forming unit to form an adjustment pattern on the photosensitive member, causes the developing device to develop the adjustment pattern during the adjustment sequence, and adjusts an amount of laser light from the optical scanning device based on the density of the developed adjustment pattern detected by the density detection unit.

5. The image forming apparatus according to claim 1, further comprising a potential detection unit configured to detect a potential on the photosensitive member, wherein the control unit adjusts an amount of laser light from the optical scanning device based on a detection result detected by the potential detection unit.

6. The image forming apparatus according to claim 1, further comprising a thermo-hygro sensor configured to detect a temperature and a humidity, wherein the control unit detects a water content in air based on a detection result from the thermo-hygro sensor, and in a case where the water content detected during execution of the adjustment sequence is changed by a predetermined amount or more, the control unit generates the execution signal.

7. The image forming apparatus according to claim 1, wherein the second predetermined value is greater than or equal to 90% of the first predetermined value.

8. The image forming apparatus according to claim 1, wherein a sheet is one side of the sheet.

9. The image forming apparatus according to claim 1, further comprising a counter configured to store a count value that is a number of sheets on which respective image forming operations has been performed by the image forming unit, wherein the count value is reset in accordance with an execution of the cleaning sequence by the cleaning member.

* * * * *